US005919049A

United States Patent [19]

Petersen et al.

[11] Patent Number: 5,919,049

[45] Date of Patent: Jul. 6, 1999

[54] HIGH SPEED CARD EDGE CONNECTOR WITH FOUR BLADED GROUND CONTACT

[75] Inventors: Carl C. Petersen, Mentor, Ohio; Ronald P. Sidor, Stratford, Conn.; Robert J. Shiley, II, York, Pa.

[73] Assignee: Framatome Connectors USA, Inc., Fairfield, Conn.

[21] Appl. No.: 08/853,385

[22] Filed: May 8, 1997

[51] Int. Cl.[6] ..... H01R 9/09

[52] U.S. Cl. ..... 439/60; 439/636

[58] Field of Search ..... 439/636, 637, 439/60

[56] References Cited

U.S. PATENT DOCUMENTS

| | | | |
|---|---|---|---|
| 4,317,609 | 3/1982 | Lapraik | 439/221 |
| 4,846,734 | 7/1989 | Lytle | 439/637 |
| 4,891,023 | 1/1990 | Lopata | 439/637 |
| 4,894,022 | 1/1990 | Guckenheimer | 439/260 |
| 5,026,292 | 6/1991 | Pickles et al. | 439/108 |
| 5,051,099 | 9/1991 | Pickles et al. | 439/108 |
| 5,425,658 | 6/1995 | White | 439/637 |
| 5,634,819 | 6/1997 | Pan et al. | 439/637 |

*Primary Examiner*—Steven L. Stephan
*Assistant Examiner*—Jean F. Duverne
*Attorney, Agent, or Firm*—Perman Green, LLP

[57] ABSTRACT

A card edge connector having a housing, signal contacts and a four bladed ground contact. The housing has a card edge receiving area. The signal contacts are connected to the housing and the four bladed ground contact is also connected to the housing. The four bladed ground contact has a one piece frame with two pairs of opposing contact blades on opposite sides of the card edge receiving area in the housing.

20 Claims, 7 Drawing Sheets

HIGH SPEED CARD EDGE CONNECTOR WITH FOUR BLADED GROUND CONTACT

BACKGROUND OF THE INVENTION

1. Field of the Invention

The present invention relates to card edge connectors and, more specifically, to a high speed card edge connector with a four bladed ground contact.

2. Prior Art

Card edge connectors are generally well known in the art. Examples can be found in the following U.S. Pat. Nos.: 4,846,734; 4,891,023; 4,894,022; 5,026,292 and 5,425,658.

SUMMARY OF THE INVENTION

In accordance with one embodiment of the present invention, a card edge connector is provided comprising a housing, signal contacts and a four bladed ground contact. The signal contacts and the four bladed ground contact are connected to the housing. The housing has a card edge receiving area. The four bladed ground contact comprises a one piece frame with two pairs of opposing contact blades on opposite sides of the card edge receiving area.

In accordance with another embodiment of the present invention, a card edge connector is provided comprising a housing, signal contacts and a ground contact. The housing has a card edge receiving area. The signal contacts are connected to the housing. The ground contact is connected to the housing and located between a corresponding pair of signal contacts. The ground contact has two pairs of opposing contact blades, wherein one of the blades from each pair of blades is located on opposite sides of the card edge receiving area. The corresponding pair of signal contacts extend over the ground contact at an area generally between the contact blades on each side of the ground contact.

In accordance with yet another embodiment of the present invention, a card edge connector is provided comprising a housing with signal contacts and ground contacts connected within the housing. The housing has a card edge receiving area. Each ground contact has an upper section, a mid-section and a lower section. The mid-section has a generally U-shaped configuration with two side walls on opposite sides of the card edge receiving area. The side walls are connected by a transverse section. The upper section comprises two pairs of elongated members cantilevered from the side walls of the mid-section.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENT

Figure 1:
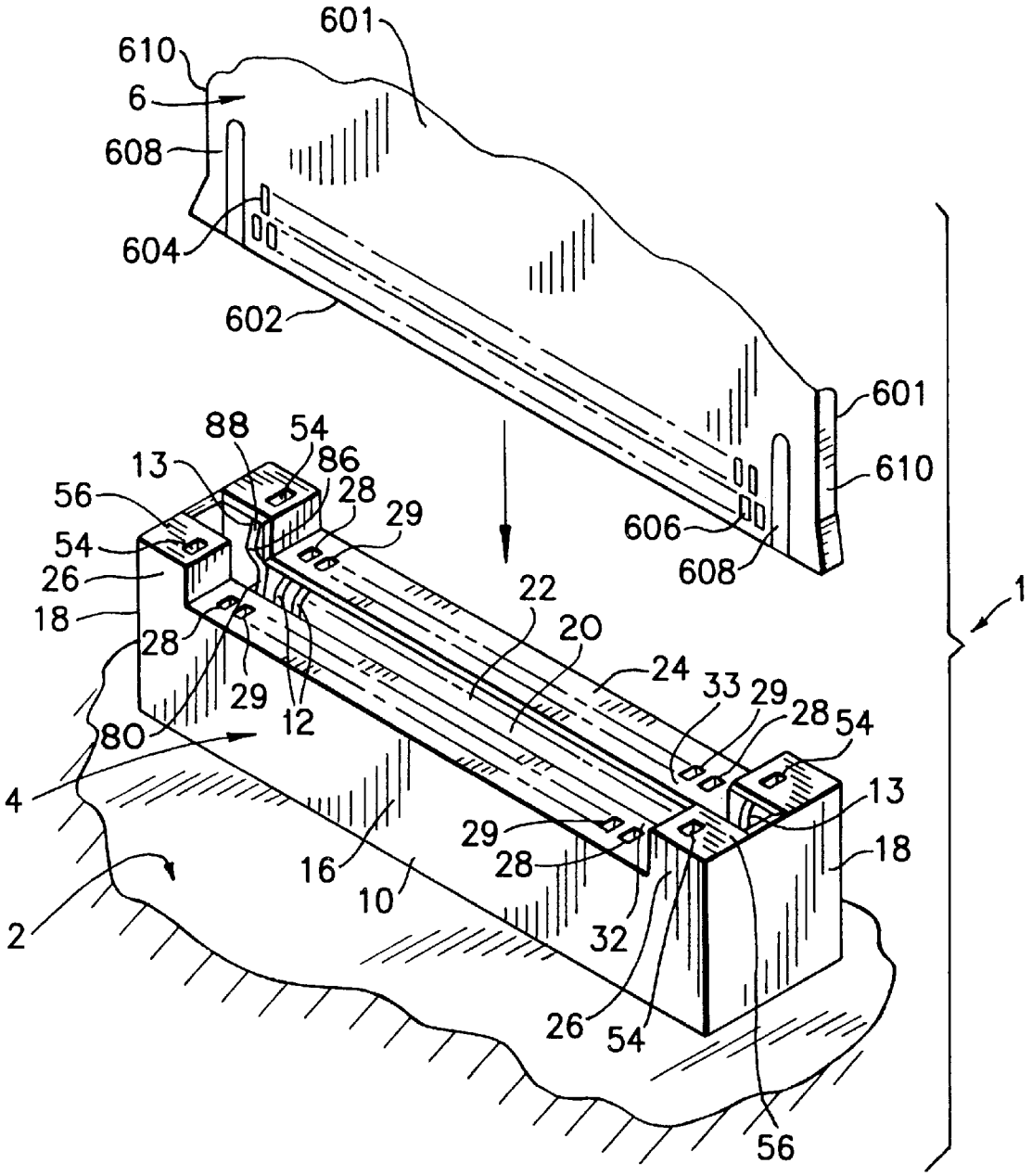
FIG. 1 is an exploded partial perspective view of a printed circuit board assembly incorporating features of the present invention.

Referring to FIG. 1, there is shown an exploded perspective view of a printed circuit board assembly 1 incorporating features of the present invention. Although the present invention will be described with reference to the single embodiment shown in the drawings, it should be understood that the present invention can be embodied in various different types of printed circuit board assemblies. In addition, any suitable size, shape or type of elements or materials could be used.

The printed circuit board assembly 1, shown in FIG. 1, generally comprises a mother printed circuit board 2, a high speed card edge connector 4 and a daughter printed circuit board 6. The card edge connector 4 is fixedly connected to the mother printed circuit board 2. The daughter printed circuit board 6 is removably connected to the card edge connector 4, and thus, the daughter board 6 is connected to the mother board 1 by the connector 4.

Figure 2:
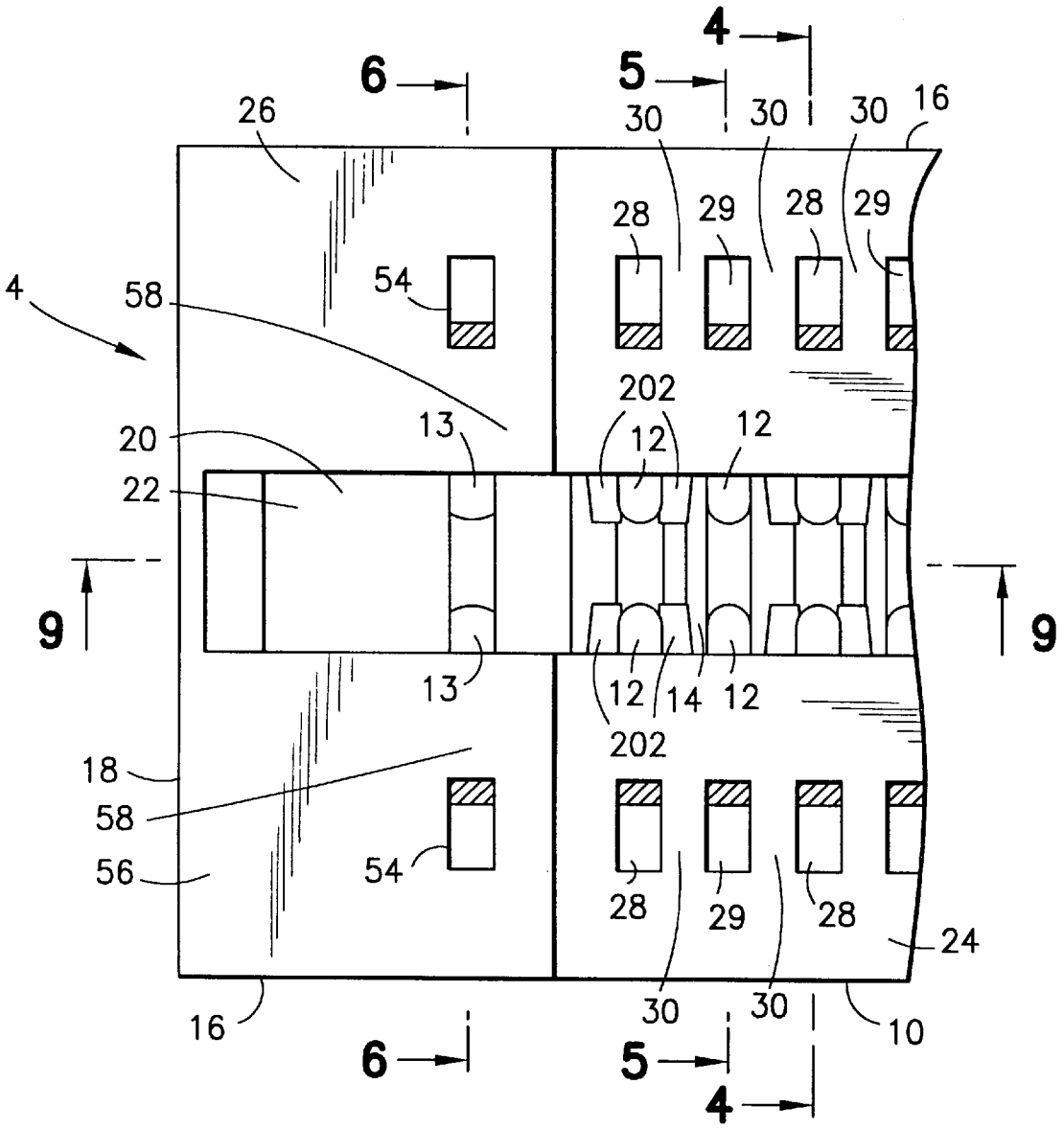
FIG. 2 is a partial top plan view of a high speed card edge connector used in the printed circuit board assembly shown in FIG. 1.
Figure 3:
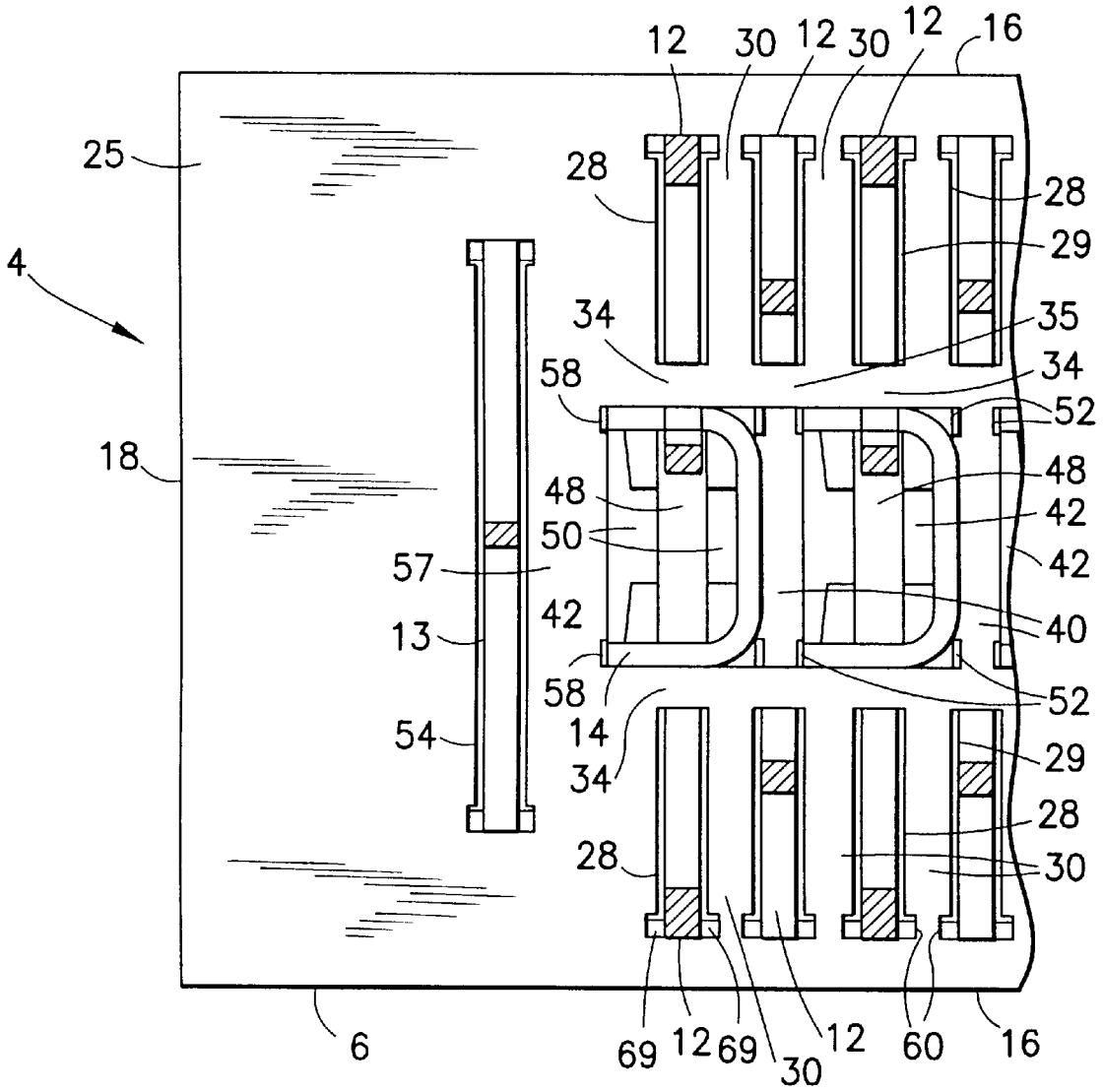
FIG. 3 is a partial bottom plan view of the high speed card edge connector shown in FIG. 2.
Figure 4:
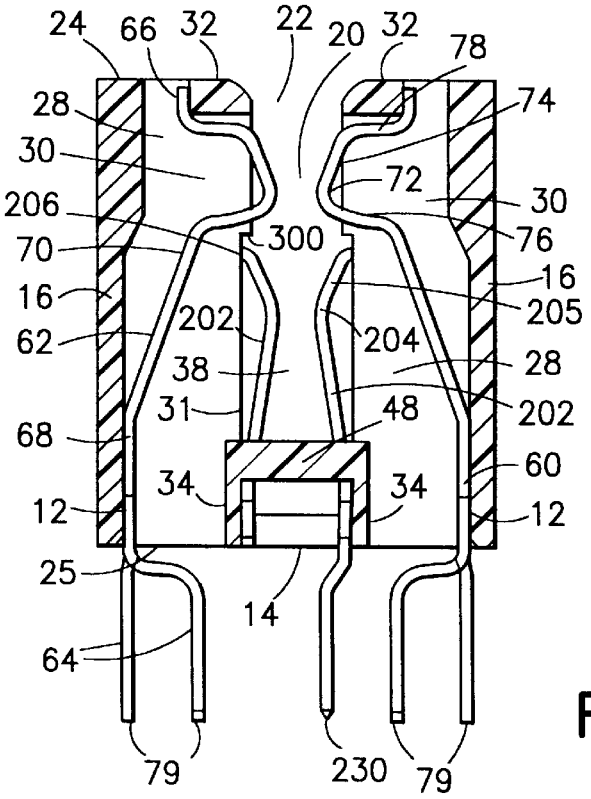
FIG. 4 is a cross-sectional view of the high speed card edge connector shown in FIG. 2 taken along line 4—4.
Figure 5:
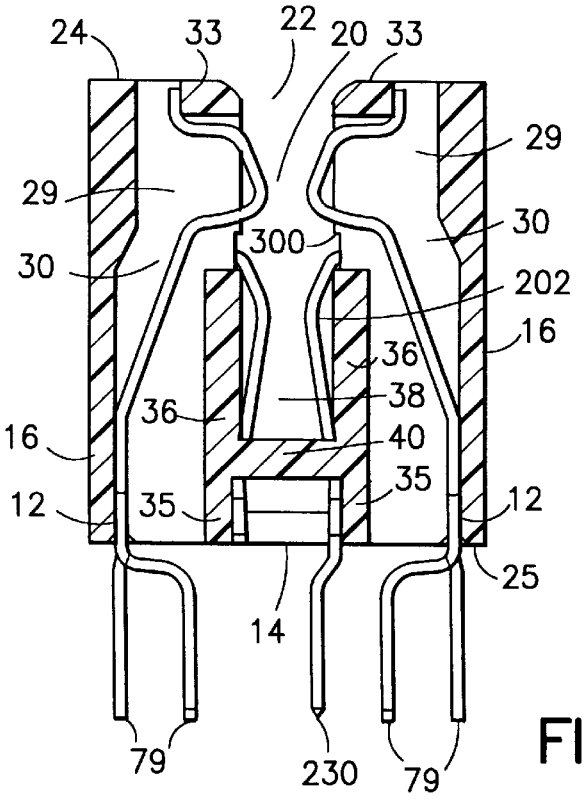
FIG. 5 is a cross sectional view of the high speed card edge connector shown in FIG. 2 taken along line 5—5.
Figure 6:
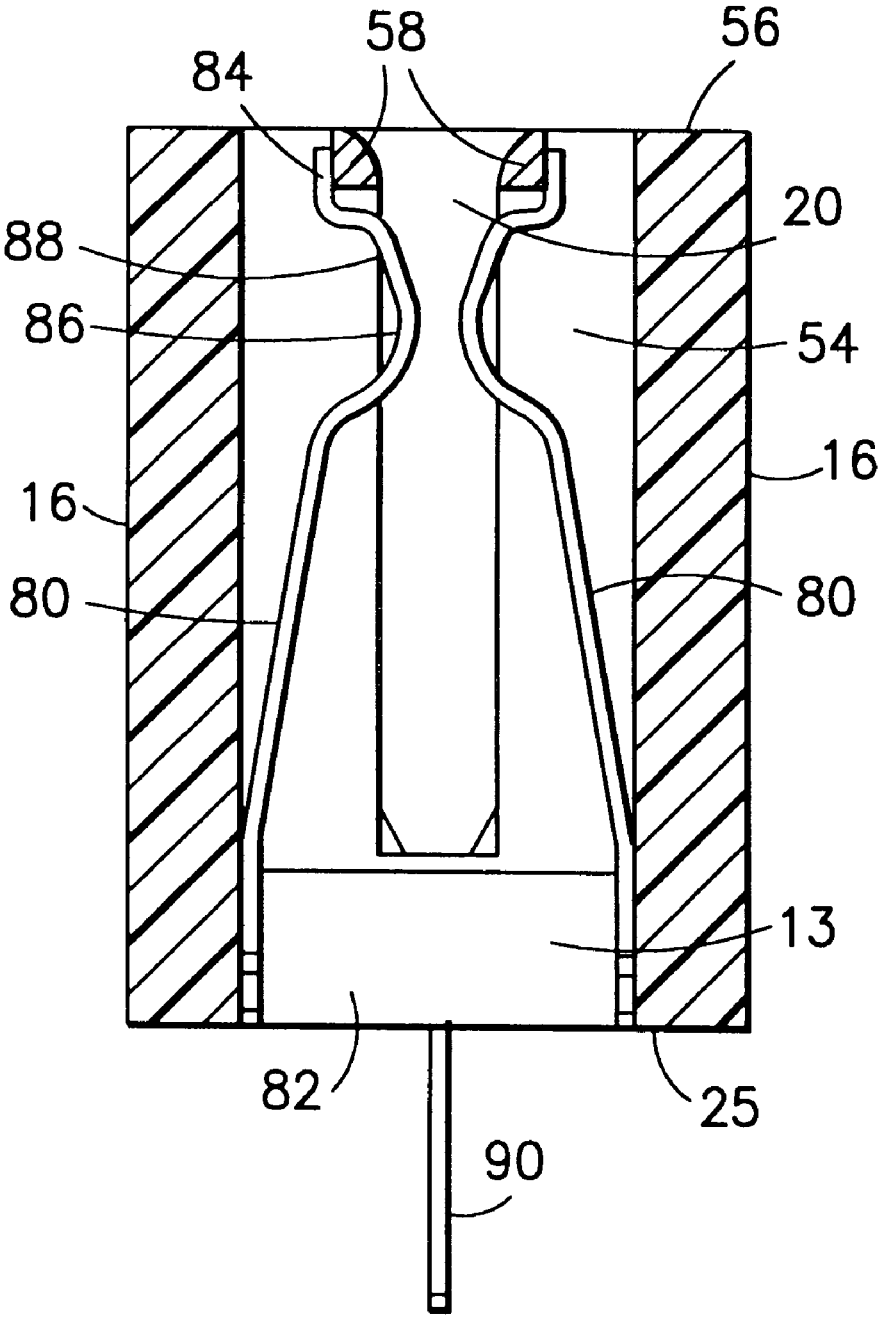
FIG. 6 is a cross-sectional view of the high speed card edge connector shown in FIG. 2 taken along line 6—6.

Referring to FIGS. 1, 2 and 3, the high speed card edge connector 4 has a housing 10, inner signal contacts 12, outer contacts 13 and ground contacts 14. The housing 10 is made from a dielectric material such as molded plastic. Referring also to FIGS. 4, 5 and 6, the housing 10 comprises longitudinal walls 16 extending between the ends 18. A central card edge receiving area 20 extends into the housing 10 from an opening 22 in the top 24 of the housing 10. In the preferred embodiment, the housing 10 has card edge receiving area end supports 26 that project from the top 24 of the housing 10 as shown in FIG. 1. One card edge receiving area end support 26 is located at each end 18 of the housing 10. In an alternate embodiment, external card edge receiving area supports may be located at any other suitable position. The end supports 26 are suitably shaped to provide support to the daughter board 6 when it is inserted into the card edge receiving area 20. The housing 10 has a central groove 38 which extends into the housing 10 from its bottom 25. The central groove 38 is generally aligned with but wider than the card edge receiving area 20. The card edge receiving area 20 communicates with the central groove 38.

The housing 10 comprises signal contact receiving channels 28, 29. Channels 28 are alternatingly located with channels 29 in two rows on opposite sides of the card edge receiving area 20. Corresponding ones of the channels 28 are first and last in each row. In the preferred embodiment, adjacent channels 28, 29 are separated by a center to center distance of about 1 mm. However, in alternate embodiments, the separation between channels may be more or less, such as about 0.05 inch. Referring now to FIGS. 2, 3, 4 and 9, channels 28 extend from the top 24 to the bottom 25 of the housing 10 and are formed by internal partitions 30 extending inward from the longitudinal walls 16. The inner edges 31 of the internal partitions 30 bound the card edge receiving area 20 and the central groove 38 below, as shown in FIG. 4. The inner edge 31 of each internal partition has an inward step 300. Preload sections 32 span between internal partitions 30 at the top 24 of each channel 28. Sides 34 span between the internal partitions 30 at the bottom of each channel 28. Channels 28 are otherwise open at the top 24 and bottom 25 and communicate with the card edge receiving area 20 between preload sections 32 and sides 34. The sides 34 are flush with the inner edges 31 of the internal partitions 30 at the bottom 25 of the housing 10. Referring now to FIGS. 2, 3, 5 and 9, channels 29 are defined by partitions 30 and extend from the top 24 to the bottom 25 of the housing 10.

Figure 9:
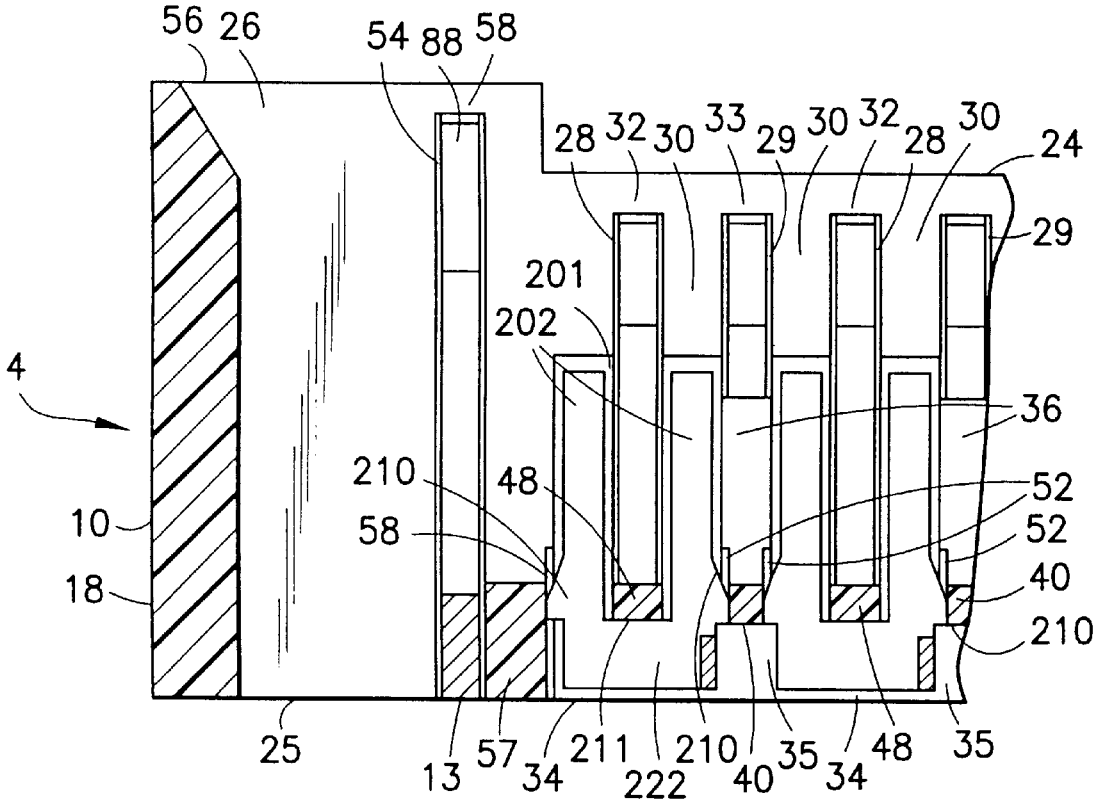
FIG. 9 is a partial longitudinal cross-sectional elevation view of the high speed card edge connector shown in FIG. 2.

Preload sections 33 span between internal partitions 30 at the top of each channel 29. Sides 35 span between the partitions 30 at the bottom of each channel 29. The sides 35 are flush with the inner edges 31 of the internal partitions 30 at the bottom 25 of the housing 10. Ground contact supports 36 extend upward from the corresponding sides 35 of the respective channels 29, and extend between corresponding internal partitions 30 as shown in FIG. 9. The ground contact supports 36 project inward into the central groove 38 until flush with the card edge receiving area 20 as shown in FIG. 5. Channels 29 are open at the top 24 and the bottom 25 and communicate with the card edge receiving area 20 between the corresponding preload sections 33 and ground contact supports 36. Dividers 40 span between respective opposing sides 35 dividing the groove 38 to form a row of ground contact receiving apertures 42 as shown in FIG. 3. Dividers 40 connect to corresponding sides 35 below the ground contact supports 36. Each divider 40 has two pairs of opposing ground contact mounting rails 52 formed therein proximate to sides 35. One of the rails 52 from each pair of rails 52 opens on each of the corresponding apertures 42 divided by each divider 40. The mounting rails 52 extend vertically along each divider 40 and continue upward partially into the corresponding ground contact support 36 as shown in FIG. 9.

In the preferred embodiment, the height of dividers 40 is less than the height of sides 35 so that the dividers do not extend the full depth of the groove 38, leaving a portion 46 of the groove 38 undivided. In alternate embodiments, the dividers may fully divide the central groove 38. Sub-dividers 48, extending between corresponding opposing sides 34 further sub-divide each aperture 42 so that each aperture 42 has two ground contact blade receptacles 50 as shown in FIG. 3.

Referring now to FIGS. 1, 2, 3, 6 and 9, the housing includes two outer contact receiving channels 54. Each channel 54 is located within a respective card edge receiving area end support 26. The outer contact receiving channels 54 extend laterally from one wall 16 to the opposite wall 16 and longitudinally from the top 56 of the end support 26 to the bottom 25 of the housing 10. The card edge receiving area 20 bi-sects the channels 54. Two preload sections 58 span each channel 54 at its top 56 on both sides of the card edge receiving area 20. At the bottom 25 of the housing 10, each channel 54 is separated from the central groove 38 by a corresponding divider 57 (see FIG. 9). Each divider 57 has two ground contact mounting rails 58, one rail 58 on opposite sides of the central groove 38. The mounting rails 58 on each divider 57 communicate with the adjoining ground contact receiving aperture 42. Each mounting rail 58 is generally aligned with the facing mounting rail 52 in the corresponding divider 40.

Referring to FIGS. 2, 3, 4 and 5, each channel 28, 29 receives a signal contact 12. The signal contacts 12 are one-piece members cut and formed from flat sheet metal. Each contact 12 has an upper portion 62 and a lower portion 64. The upper portion 62 of each contact 12 is located within the corresponding channels 28, 29. Each upper portion 62 comprises at upper seat section 66 and a lower seat section 68. The upper seat section 66 and lower seat section 68 of each contact 12 are joined by a connecting spring arm 70. When the upper seat section 62 of each contact 12, is located within its corresponding channel 28, 29, the lower seat section 68 is seated against the outer wall 16. Laterally projecting detents 69, shown in FIG. 3, on each lower seat section 68 engage complementing recesses 60 in corresponding partitions 30 thereby fixedly connecting each signal contact 12 to the housing 10. Referring specifically to FIG. 4, the upper seat section 66, of each contact 12, seats against the corresponding preload section 32, 33 preloading the spring arm 70. Proximate the upper seat surface 66, each spring arm 70 has a coined contact area 72 projecting into the card edge receiving area 20 sufficiently to contact the daughter board 6 inserted therein. A cam surface 74 extends upward and outward from the contact area 72. In the preferred embodiment, the spring arm 70, generally inclines upward and inward from the lower seat section 68 to the upper seat section 66. Generally horizontal lower offset section 76 and upper offset section 78 connect the contact area 72, to the spring arm 70. In alternate embodiments the connecting spring arm between the lower seat 68 and upper seat 66 sections may have any suitable shape that projects the contact area 72 into the card edge receiving area 20. The lower portion 64 of each signal contact 12 comprises a solder tail 79 cantilevered from the lower seat section 68 and extending below the bottom 25 of the housing 10. The solder tails 79 are mounted through holes, (not shown), in the mother board 2 fixedly connecting the card edge connector 4 to the board 2. In an alternate embodiment, the solder tails could be surface mount solder tails.

Outer contacts 13 are located in corresponding outer channels 54. As shown in FIG. 6, the outer contacts 13 are one-piece members made from sheet metal. Each contact 13 has two opposing contact arms 80, a mid-section 82, and a solder tail 90 extending from the mid-section 82. The mid-section 82 is a substantially flat and rigid sheet section.

Each mid-section 82 is sized to form a force fit with the walls 16 when the respective outer contact 13 is inserted into the corresponding outer channel 54. The two opposing contact arms 80 cantilever upwards from the mid-section 82 on both sides of the card edge receiving area 20. Each contact arm 80 terminates in an upper seat section 84, seated against the corresponding preload section 58 and preloading the spring arms 80. Each spring arm 80 has a coined contact area 86 projecting into the card edge receiving area 20 to contact the daughter board 6 inserted therein. A cam surface 88 extends upward and outward from each contact area 86. The solder tail 90 of each outer contact 13, cantilevers downward from the mid-section 82, extending from the bottom 25 of the housing 10. Each solder tail 90 is mounted through a hole, (not shown), fixedly connecting the outer contact 13 to the mother board 2. In an alternate embodiment, the solder tails could be surface mount solder tails.

Figure 8:
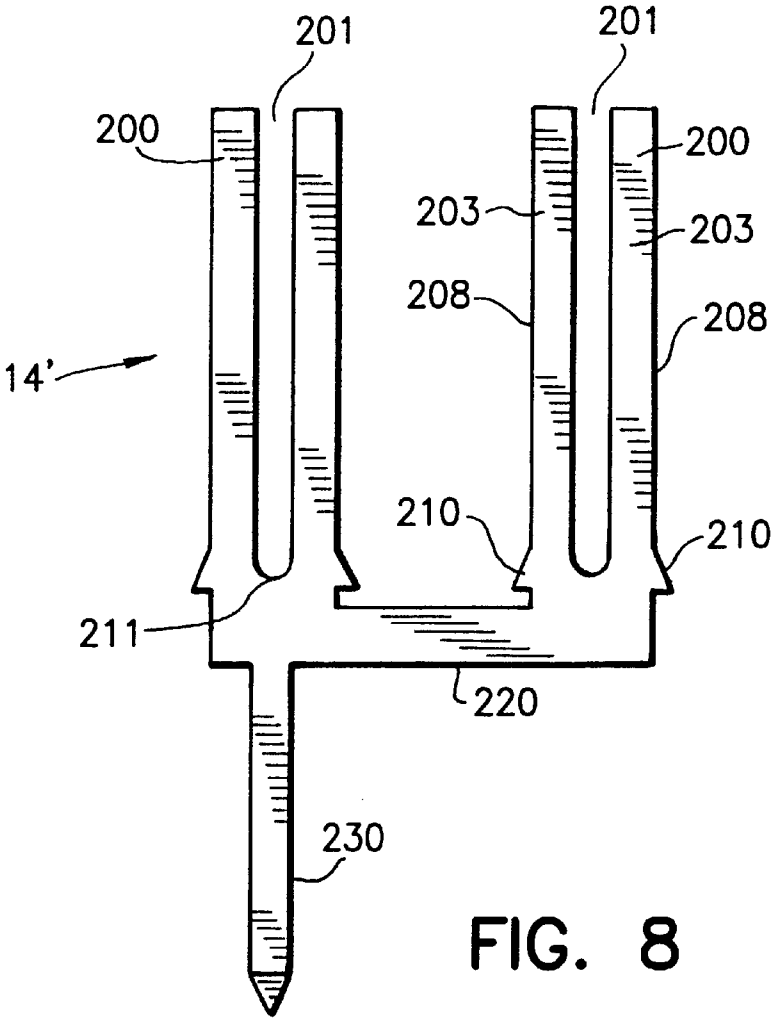
FIG. 8 is a side elevation view of a blank used to make the four bladed ground contact shown in FIG. 7.
Figure 7:
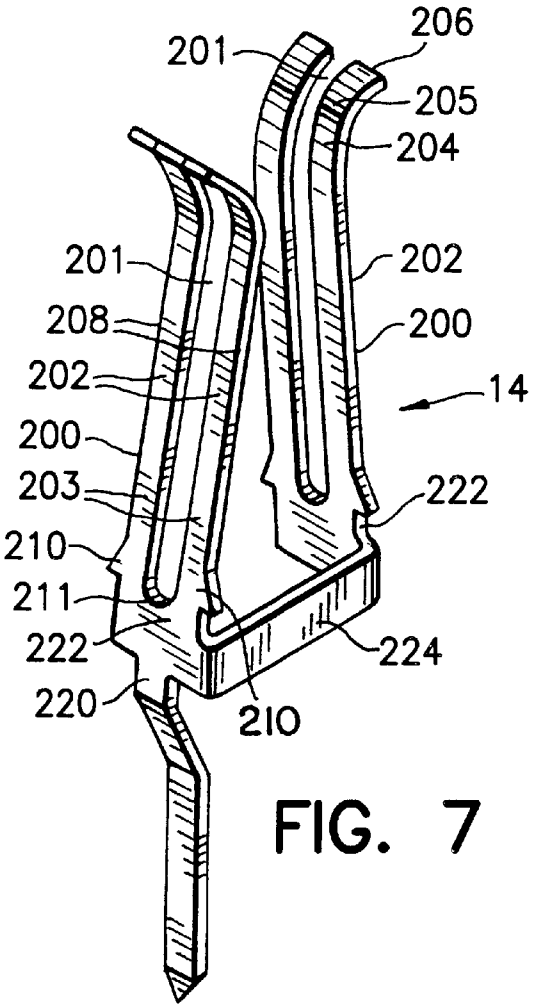
FIG. 7 is a perspective view of a four bladed ground contact used in the high speed card edge connector shown in FIG. 3.

Referring now to FIGS. 7 and 8, the ground contacts 14 are one-piece members cut and formed from sheet metal. FIG. 8 shows a blank 14' of the contact 14 shown in FIG. 7 after the blank has been cut or stamped from the sheet metal, but before it has been bent into the shape shown in FIG. 7. Preferably, the blank 14' is formed on a carry strip (not shown) connected to the carry strip by the solder tails 230. After each ground contact 14 is cut or stamped from the sheet metal, each ground contact 14 has two outer arms 200 cantilevered from a middle connecting strip 220. Each longitudinal edge 208 of each arm 200 has a projecting detent 210 proximate the connecting strip 220. Each ground contact 14 also has a solder tail 230 cantilevered from the connecting strip 220, below and opposite one of the outer arms 200. A partial slot 201 is cut in each arm 200 forming two substantially elongated members 203, wherein each ground contact 14 has four elongated members 203. The middle connecting strip 220 is formed to have two parallel outer side walls 222 connected by a transverse section 224 as shown in FIG. 7. Each arm 200 extends upward from each side wall 222. The elongated members 203 on one side wall 222 are generally aligned with and parallel to the elongated members 203 on the opposing wall 222. Thus, each ground contact 14 has two pairs of opposing elongated members .203. In the preferred embodiment, the middle connecting strip 220 is formed into a general U-shape. In alternate embodiments, the middle connecting strip 220 may be formed into any other suitable shape having two opposing walls connected by a transverse section. Each elongated member 203 forms a contact blade 202 of the ground contact 14. Each contact blade 202 has a inwardly projecting coined contact area 204 with a cam surface 205 inclined upward and outwards from the contact area 204 to the tip 206 of each member 203. At the contact area 204, the contact blades 202 on each side wall 222 are separated by a center to center distance of about 1 mm.

Referring to FIGS. 2, 3, 4, 5 and 9, a ground contact 14 is located within each ground contact receiving aperture 42 between a pair of corresponding signal contacts 12 in opposing channels 28. Each ground contact 14 is inserted in the corresponding ground contact receiving aperture 42 with the side walls 222 positioned adjacent the sides 34 of the aperture 42. During insertion, each subdivider 48 is received in the mating slots 201 between pairs of blades 202 as the pairs of blades 202 on the corresponding ground contact 14 enter the ground contact blade receptacles 50.

Insertion of each ground contact 14 is stopped when the corresponding subdivider 48 contacts the end 211 of the mating slots 201. Each ground contact 14 in the housing 10 has one pair of blades 202 separated from the other pair of blades 202 by the corresponding sub-divider 48, and has one of the blades 202 from each pair of blades 202 on opposite sides of the card edge receiving area 20. The solder tails 230 of respective ground contacts 14 extend from the bottom 25 of the housing 10 and are through-hole mounted, (not shown), to the mother board 2. Projecting detents 210 are admitted into the mating rails 52, 58 of the corresponding dividers 40, 57 and ground contact supports 36. The detents 210 project sufficiently to achieve a force fit fixedly connecting the ground contacts 14 to the housing 10. The coined contact areas 204 and adjoining cam surfaces 205, of the ground contacts 14 extend into the card edge receiving area 20. Each pair of contact blades 202 on the respective ground contacts 14 is located between a corresponding pair of internal partitions 30. As shown in FIGS. 4 and 5, the length of the contact blades 202 is adapted so that the tips 206 are sufficiently below the steps 300 in the internal partitions 30 to avoid interference when the blades 202 are deflected outwards. The lower offsets 76 on the signal contacts 12 in corresponding channels 28 extend generally over and between the two pairs of blades 202 of each ground contact 14. On each side of the card edge receiving area 20, the contact area 72 of each signal contact 12 is located above and between two corresponding contact blades 202. The contact areas 72 of signal contacts 12 are longitudinally separated from adjacent contact blades 202 by a center to center distance of about 0.025 inch. In the preferred embodiment, the ratio of signal contacts 12 and contact arms 80 to contact blades 202 on the ground contacts 14 is about 1 to 1. In alternate embodiments the ratio may be different.

Referring now to FIG. 1, the daughter printed circuit board 6 has two sides 601. Each side 601 has an upper row of signal pads 604 and a lower row of ground pads 606 proximate the bottom edge 602 of the daughter board 6.

The signal pads 604 and ground pads 606 on each side 601 of the board 6 are located so that the signal pads 604 contact the contact areas 72 (see also FIG. 4) of the signal contacts 12 and ground pads 606 contact the contact areas 204 of ground contacts 14, when the daughter board 6 is inserted in the card edge receiving area 20. The daughter board 6 has two outer pads 608 on each side 601. One outer signal pad 608 on each side 601 is located proximate each vertical edge 610. Pads 608 contact the contact areas 86 of contact arms 80, when the daughter board 6 is inserted into the card edge receiving area 20. The pads 608 and contacts 13 can provide power and/or ground connections between the mother and daughter boards.

The daughter board 6 is inserted, bottom edge 602 first, into the card edge receiving area 20 through the opening 22 in the top 24 of the housing 10. During insertion, the daughter board 6 is supported by the card edge receiving area end supports 26. The sides 601 of the daughter board 6 cooperate first with the cam surfaces 88 on opposing signal contacts 80 in the end supports 26, resiliently deflecting the corresponding spring arms 80 outward. The spring arms 80 bring the contact areas 86 of the contact arms 80 into contact with the corresponding outer pads 608 on the daughter board 6. As the daughter board 6 is inserted further, its sides 601 cooperate next with cam surfaces 74 resiliently deflecting the corresponding spring arms 70 of opposing signal contacts 12 (see FIGS. 1 and 4). The contact areas 72 of the opposing signal contacts 12 ride over the lower ground pads 606 on the sides 601 of the daughter board 6 and contact the corresponding signal pads 604. Referring still to FIGS. 1 and 4, the sides 601 of the daughter board 6 cooperate ultimately with cam surfaces 205 resiliently deflecting corresponding blades 202 of the ground contacts 14. The daughter board 6 is inserted between the outwardly deflected opposing blades 202 bringing the contact areas 204 into contact with corresponding ground pads 606 on both sides 601 of the daughter board 6. When insertion of the daughter board 6 is complete, the contact areas 86 of outer signal contacts 80 contact corresponding outer signal pads 608, the contact areas 72 of signal contacts 12 contact corresponding signal pads 604 and the contact areas 204 of the ground contacts 14 contact corresponding ground pads 606.

The present invention provides a high speed card edge connector 4 with contacts 12, 13 and 14 making contact with both sides 601 of the daughter board 6 inserted therein. The ratio of signal contacts 12, 13 to contact blades 202 or ground contacts 14 is about 1 to 1. The contact blades 202 of the respective ground contacts 14 located between corresponding signal contacts 12 on each side 601 of the daughter board 6 may reduce the electromagnetic effects between signal contacts 12 and facilitate a higher rate of signal transmission through the card edge connector 4 in comparison to other card edge connectors. In alternate embodiments, the card edge connector may have signal contacts and ground contact blades contact on only one side of a daughter printed circuit board inserted therein.

It should be understood that the foregoing description is only illustrative of the invention. Various alternatives and modifications can be devised by those skilled in the art without departing from the scope of the invention.

Accordingly, the present invention is intended to embrace all such alternatives, modifications and variances which fall within the scope of the appended claims.

What is claimed is:

1. A card edge connector, comprising:

a housing with a card edge receiving area;

signal contacts connected to the housing; and a four bladed ground contact connected to the housing, wherein the four bladed ground contact comprises a one-piece frame with two pairs of opposing contact blades, one of the blades from each pair of blades being located on opposite sides of the card edge receiving area, and wherein a corresponding one of the signal contacts has a portion located above and generally between the two pairs of contact blades of the ground contact.

2. A card edge connector as in claim 1, wherein the four bladed ground contact comprises an upper section, a mid-section and a lower section, the mid-section having side-walls on opposite sides of the card edge receiving area connected by a transverse portion and the upper section comprising the two pairs of the contact blades as resiliently flexible elongated members cantilevered from the side walls.

3. A card edge connector as in claim 2, wherein the lower section has a single solder tail for connecting the four bladed ground contact to a mother board, the single solder tail extending from one of the side walls.

4. A card edge connector as in claim 2, wherein each elongated member is substantially flat with a coined contact area which contacts a mating ground pad on a daughter board when the daughter board is inserted into the card edge receiving area.

5. A card edge connector as in claim 4, wherein each elongated member has a cam surface extending between the contact area and an upper end of the elongated member, the cam surfaces on opposing elongated members guiding the daughter board between the opposing contact blades, when the daughter board is inserted into the card edge receiving area.

6. A card edge connector as in claim 2, wherein on each side wall, the two elongated members are separated by a center to center distance of about 1 mm.

7. A card edge connector as in claim 2, wherein the housing has a bottom with an aperture admitting the four bladed ground contact, the side walls of the mid-section making an interference fit with the housing when the ground contact is located in the aperture.

8. A card edge connector as in claim 1, further comprising a plurality of the ground contacts connected to the housing.

9. A card edge connector as in claim 8, wherein each four bladed ground contact is located between a corresponding pair of signal contacts positioned on opposite sides of card edge receiving area, the corresponding signal contacts canting over generally between the pairs of contact blades on each four bladed ground contact.

10. A card edge connector as in claim 8, wherein a sufficient number of four bladed ground contacts are located within the housing so that the signal contacts and blades on the ground contacts have a ratio of about 1 to 1.

11. A card edge connector, comprising:

a housing with a card edge receiving area;

signal contacts connected to the housing; and a ground contact connected to the housing, the ground contact being located between a corresponding pair of signal contacts and having two pairs of opposing contact arms, one of the arms from each pair of arms being located on opposite sides of the card edge receiving area, wherein the corresponding pair of signal contacts extend over the ground contact at an area generally between two of the contact arms of the ground contact on each side of the card edge receiving area.

12. A card edge connector as in claim 11, wherein the ground contact is a one-piece member, cut and formed from sheet metal.

13. A card edge connector as in claim 12, wherein each contact arm comprises an elongated section cantilevered from a generally U-shaped section of the ground contact, one arm from each pair of arms extending from opposite walls of the U-shaped section.

14. A card edge connector as in claim 13, wherein on each wall of the U-shaped section the two arms are separated from each other by a center to center distance of about 1 mm.

15. A card edge connector as in claim 13, wherein the ground contact has a solder tail for connecting to a mother board, the solder tail extending from a lower edge of the unshaped section.

16. A card edge connector as in claim 12, wherein each contact arm is substantially flat.

17. A card edge connector, comprising:

a housing with a card edge receiving area;

signal contacts connected to the housing; and ground contacts connected to the housing, each ground contact having an upper section, a mid-section and a lower section, the mid-section having a generally U-shaped configuration with two side walls on opposite sides of the card edge receiving area connected by a transverse section and the upper section comprising two pairs of elongated cantilever arms, with the two cantilever arms of each pair of cantilever arms being cantilevered from a corresponding one of the side walls of the mid-section; wherein each cantilever arm from each pair of cantilever arms is deflected independently when a card edge is inserted between the two pairs of cantilever arms.

18. A card edge connector as in claim 17, wherein each ground contact has a solder tail extending from a lower edge of the U-shaped mid-section of the ground contact.

19. A card edge connector as in claim 17, wherein each ground contact is located between a corresponding pair of signal contacts positioned on opposite sides of the card edge receiving area.

20. A card edge connector as in claim 17, wherein each ground contact is disposed between a corresponding pair of the signal contacts, and wherein each signal contact from the pair of signal contacts extends over and generally between the two cantilever arms of a corresponding one of the two pairs of cantilever arms of the ground contact to reduce the electromagnetic effects and facilitate a higher rate of signal transmission between the pair of signal contacts and a card inserted into the card edge receiving area.

* * * * *